US011066730B2

(12) United States Patent
Bae et al.

(10) Patent No.: US 11,066,730 B2
(45) Date of Patent: Jul. 20, 2021

(54) ALLOY MATERIAL IN WHICH ARE DISPERSED OXYGEN ATOMS AND A METAL ELEMENT OF OXIDE-PARTICLES, AND PRODUCTION METHOD FOR SAME

(75) Inventors: Dong Hyun Bae, Seoul (KR); Hun Kang, Daejeon (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 904 days.

(21) Appl. No.: 14/000,661

(22) PCT Filed: Jun. 22, 2012

(86) PCT No.: PCT/KR2012/004940

§ 371 (c)(1),
(2), (4) Date: Aug. 21, 2013

(87) PCT Pub. No.: WO2012/177074

PCT Pub. Date: Dec. 27, 2012

(65) Prior Publication Data

US 2014/0186207 A1 Jul. 3, 2014

(30) Foreign Application Priority Data

Jun. 23, 2011 (KR) ..... 10-2011-0060963
Aug. 19, 2011 (KR) ..... 10-2011-0082532
Jun. 18, 2012 (KR) ..... 10-2012-0064752

(51) Int. Cl.
*C22C 23/02* (2006.01)
*C22C 23/00* (2006.01)
(Continued)

(52) U.S. Cl.
CPC ..... *C22C 23/00* (2013.01); *C22C 1/1036* (2013.01); *C22C 23/02* (2013.01); *C22F 1/06* (2013.01)

(58) Field of Classification Search
CPC ..... C22C 23/00; C22C 23/02
See application file for complete search history.

(56) References Cited

U.S. PATENT DOCUMENTS 6,395,224 B1 * 5/2002 Nishino ..... C22C 1/03 148/420
2009/0028743 A1 * 1/2009 Gupta ..... B21C 23/002 420/405

(Continued)

FOREIGN PATENT DOCUMENTS

JP 63235444 A * 9/1988 ..... C22C 19/03
JP 01123043 A * 5/1989 ..... C22C 19/03

(Continued)

OTHER PUBLICATIONS

Barison. Characterisation of surface oxidation of nickel-titanium alloy by ion-beam and electrochemical techniques. Electrochimica Acta 50 (2004) 11-18 (Year: 2004).*
Hakl. Creep behaviour and microstructural stability of cast nickel based superalloy IN 792 5A. Kovove Mater. 45 2007 177-188 (Year: 2007).*

(Continued)

*Primary Examiner* — Matthew E. Hoban

(57) ABSTRACT

According to one embodiment of the present invention, a cast alloy material is provided. The cast alloy material includes a matrix metal and an alloy element, wherein oxide particles in a nanometer scale are decomposed in the matrix metal, so that a new phase including a metal element that is a component of the oxide particles and the alloy element forms a band or network structure, wherein the metal element and the alloy element have a relationship of a negative heat of mixing, and wherein oxygen atoms formed by decomposition of the oxide particles are dispersed in the matrix metal and do not form an oxide with the matrix metal.

9 Claims, 11 Drawing Sheets

(51) Int. Cl.
*C22C 1/10* (2006.01)
*C22F 1/06* (2006.01)

(56) References Cited

U.S. PATENT DOCUMENTS

| | | | | |
|---|---|---|---|---|
| 2009/0165898 | A1* | 7/2009 | Wong et al. | 148/402 |
| 2010/0052261 | A1* | 3/2010 | Maldonado | 277/322 |

FOREIGN PATENT DOCUMENTS

| | | |
|---|---|---|
| JP | 09-087778 | 3/1997 |
| JP | 09-184031 | 7/1997 |
| KR | 10-2009-0078039 | 7/2009 |
| KR | 10-2010-0034773 | 4/2010 |

OTHER PUBLICATIONS

Chen. Measurement of oxide film growth on Mg and A1 surfaces over extended periods using XPS.Surface Science 382 (1997) L652 L657 (Year: 1997).*

Zhu. Formation of intermetallic compound coating on magnesium AZ91 cast alloy. 2009 IOP Conf. Ser.: Mater. Sci. Eng. 4 012024.*

Caceres. Effects of solidification rate and ageing on the microstructure and mechanical properties of AZ91 alloy. Materials Science and Engineering: A vol. 325, Issues 1-2, Feb. 28, 2002, pp. 344-355 (Year: 2002).*

Zhao, machine translation of CN 102061421. First filed on Jan. 31, 2011. Retrieved from https://patents.google.com/patent/CN102061421B/en?oq=CN102061421 on Jul. 4, 2020 (Year: 2011).*

* cited by examiner

| | $E_{corr}$ | $I_{corr}$ |
|---|---|---|
| AZ91 | -1.35 | $1x10^{-4}$ |
| Mg-12Al-3vol%$TiO_2$ | -1.31 | $1.13x10^{-6}$ |
| Mg-12Al-3vol%$TiO_2$ (oxidation) | -0.22 | $1.6x10^{-9}$ |

ALLOY MATERIAL IN WHICH ARE DISPERSED OXYGEN ATOMS AND A METAL ELEMENT OF OXIDE-PARTICLES, AND PRODUCTION METHOD FOR SAME

TECHNICAL FIELD

The present invention relates to an alloy material, particularly, to an alloy material such as a Mg alloy having improved mechanical characteristics and corrosion resistance and a method of manufacturing the same, and more particularly, to an alloy material such as a Mg alloy having improved mechanical characteristics, corrosion characteristics and the like by homogenization heat treatment, unlike the common idea, and a method of manufacturing the same.

BACKGROUND ART

Mg is an environmental friendly material that has a density of 1. 74 g/cm$^3$ which is merely ⅕ of Fe and ⅔ of Al, generally has superior strength and can be easily recycled. Mg is also evaluated as an ultra-lightweight structural material, the specific strength and elastic coefficient of which are comparable to those of other lightweight materials, such as Al. In addition, Mg exhibits a superior ability to absorb vibration, impact, electromagnetic wave and the like, and has superior electrical and thermal conductivities.

However, Mg and Mg alloys have the fundamental problem of poor corrosion resistance despite of the above-mentioned excellent characteristics. Since it is known that Mg rapidly corrodes under electromotive force (EMF) and in a galvanic reaction due to its high reactivity, the use of Mg is limited to internal parts in which corrosion environment conditions are not strict or regions in which strength, thermal resistance or corrosion resistance is not highly required. Therefore, although a technology for fundamentally improving the corrosion resistance of Mg and Mg alloys is still required, this requirement is not satisfied by present technologies.

In the meantime, there are attempts to compensate for the drawbacks of Mg by inputting oxide particles of, for embodiment, Ca oxide, into a Mg material (e.g., Korean Patent Publication No. 10-2009-78039). However, when the Ca oxide is strongly stirred or exposed for a long time in a molten metal, oxygen floats on a surface of the molten metal, thereby forming impurities. Such impurities must be removed, which is problematic. When the Ca oxide is added to Mg, it is known that Mg and Ca form a compound and O bonds with Mg to form impurities. Such impurities (e.g. MgO) lower the corrosion resistance of Mg.

In addition, heat treatment is generally performed when manufacturing a material. That is, when homogenization heat treatment such as O-tempering is performed, elongation increases as eutectic structures disappear. Precipitates are created (precipitation hardening) by low-temperature heat treatment in addition to such homogenization heat treatment, thereby improving mechanical characteristics, such as the strength or hardness, of the material. In the meantime, while the homogenization heat treatment increases elongation, strength is decreased as the second phase disappears. In the related art, the decrease in strength due to the homogenization heat treatment was accepted as being natural, and there have been no attempts to improve this strength.

DISCLOSURE

Technical Problem

The present invention has been made to solve the foregoing problems with the prior art, and therefore an object of the present invention is to provide an alloy material in which the mechanical characteristics and corrosion resistance of a matrix metal are improved using metal oxide particles.

Another object of the present invention is to provide an alloy material in which the mechanical characteristics as well as the corrosion characteristics can be improved by homogenization heat treatment using metal oxide nanoparticles and a method of manufacturing the same.

Technical Solution

In order to realize the foregoing object, the present invention provides a cast material including a matrix metal wherein particles of an oxide are decomposed in the matrix metal, such that a metal element and oxygen (O) atoms which are components of the oxide are dispersed in the matrix metal, and the oxygen atoms do not form an oxide with the matrix metal.

According to the present invention, the cast material includes no particles of the oxide.

According to the present invention, the oxygen atoms of the oxide particles may be preferentially dispersed in the matrix metal, and the metal element of the oxide particles may be subsequently dispersed in the matrix metal, thereby mixing with the matrix metal.

According to an embodiment of the present invention, the matrix metal may be Mg or a Mg alloy, and the oxide particles may be particles of at least one oxide selected from among Ti oxides (TiOx), Mn oxides (MnOx), Zr oxides (ZrOx), Cr oxides (CrOx) and Fe oxides (FeOx).

In another aspect of the present invention, provided is a method of manufacturing a cast material that includes the following steps of: preparing a molten metal of a matrix metal; and inputting oxide particles into the molten metal and decomposing the oxide particles, so that the oxygen atoms that are a component of the oxide particles are primarily dispersed into the matrix metal and the metal element which is a component of the oxide particles is subsequently dispersed into the matrix metal, thereby manufacturing a cast material in which the oxygen atoms and the metal element are dispersed in the matrix metal, wherein the oxygen atoms do not form an oxide with the matrix metal.

According to an embodiment of the present invention, the cast material may not include the oxide particles.

In a further aspect of the present invention, provided is a cast alloy material. The cast alloy material includes a matrix metal and an alloy element. Oxide particles in the nanometer scale are decomposed in the matrix metal, so that a new phase including a metal element that is a component of the oxide particles and the alloy element forms a band or network structure. The metal element and the alloy element have a relationship of a negative heat of mixing. Oxygen atoms formed by decomposition of the oxide particles are dispersed in the matrix metal and do not form an oxide with the matrix metal.

According to an embodiment of the present invention, the metal element and the matrix metal may have a relationship of a positive heat of mixing or a relationship of a negative heat of mixing, an absolute value of the negative heat of mixing being smaller than that of the negative heat of mixing between the metal element and the alloy element.

According to an embodiment of the present invention, a compound of the metal element that is a component of the oxide particles and the matrix metal may not be formed.

According to an embodiment of the present invention, the new phase may be formed during a process of homogenization heat treatment, so that mechanical characteristics and corrosion characteristics are improved, compared to those before heat treatment. The homogenization heat treatment may be O-tempering.

According to an embodiment of the present invention, the matrix metal may be Mg, the alloy element may be Al, and the oxide particles may be particles of at least one oxide selected from among Ti oxides (TiOx), Mn oxides (MnOx), Cr oxides (CrOx), Zr oxides (ZrOx) and Fe oxides (FeOx).

In further another aspect of the present invention, provided is a method of manufacturing a cast alloy material. The method includes the following steps of: preparing a molten metal of a matrix metal; inputting an alloy element that has a relationship of a negative heat of mixing with the matrix metal; inputting oxide particles in the nanometer scale into the molten metal, the oxide particles including an alloy element that has a relationship of a negative heat of mixing with the alloy element, and thus decomposing the oxide particles, thereby manufacturing a cast material in which the metal element is preferentially distributed around the alloy element; and performing homogenization heat treatment for the cast material so that a new phase including the metal element and the alloy element forms a band or network structure, thereby improving mechanical characteristics and corrosion characteristics of the cast material, compared to those of a cast material which did not undergo the homogenization heat treatment. In the cast alloy material, oxygen atoms formed by decomposition of the oxide particles are dispersed in the matrix metal and do not form an oxide with the matrix metal.

According to an embodiment of the present invention, the mechanical characteristics may be further improved as the heat treatment time increases.

According to an embodiment of the present invention, the homogenization heat treatment may be O-tempering.

According to an embodiment of the present invention, the metal element and the matrix metal may have a relationship of a positive heat of mixing or a relationship of a negative heat of mixing, an absolute value of the negative heat of mixing being smaller than that of a negative heat of mixing between the metal element and the alloy element.

According to an embodiment of the present invention, the matrix metal may be Mg, the alloy element may be Al, and the oxide particles may be particles of at least one oxide selected from among Ti oxides (TiOx), Mn oxides (MnOx), Cr oxides (CrOx), Zr oxides (ZrOx) and Fe oxides (FeOx).

In yet another aspect of the present invention, provided is a Mg alloy material that includes a Mg matrix metal and an alloy element having a relationship of a negative heat of mixing with the Mg matrix metal. Oxide particles in the nanometer scale including a metal element that has a relationship of a positive heat of mixing with the Mg and a relationship of a negative heat of mixing with the alloy element are decomposed, so that a new phase including the metal element that is a component of the oxide particles and the alloy element forms a band or network structure. Oxygen atoms formed by decomposition of the oxide particles are dispersed in the Mg matrix metal and do not form an oxide with the Mg.

Advantageous Effects

According to the present invention, it is possible to manufacture a cast material by decomposing particles of an oxide in a molten metal to thus disperse a metal element and oxygen atoms, which compose the oxide, into a matrix metal. As the oxygen atoms are dispersed, the cast alloy material exhibits superior mechanical characteristics and corrosion resistance, compared to the other alloys. In addition, even though homogenization heat treatment is performed, a new phase including the alloy element and the metal element which is formed by the decomposition of the oxide particles forms a band or network structure, thereby improving the mechanical characteristics such as strength and corrosion characteristics of the alloy material.

MODE FOR INVENTION

Reference will now be made in detail to various embodiments of the present invention with reference to the accompanying drawings. In the following description of the present invention, detailed descriptions of well-known technologies will be omitted. However, the following embodiments will enable a person having ordinary skill in the art to easily understand the characteristic constitutions and effects of the present invention and put the present invention into practice with no significant difficulties.

A. Embodiment 1

Figure 1:
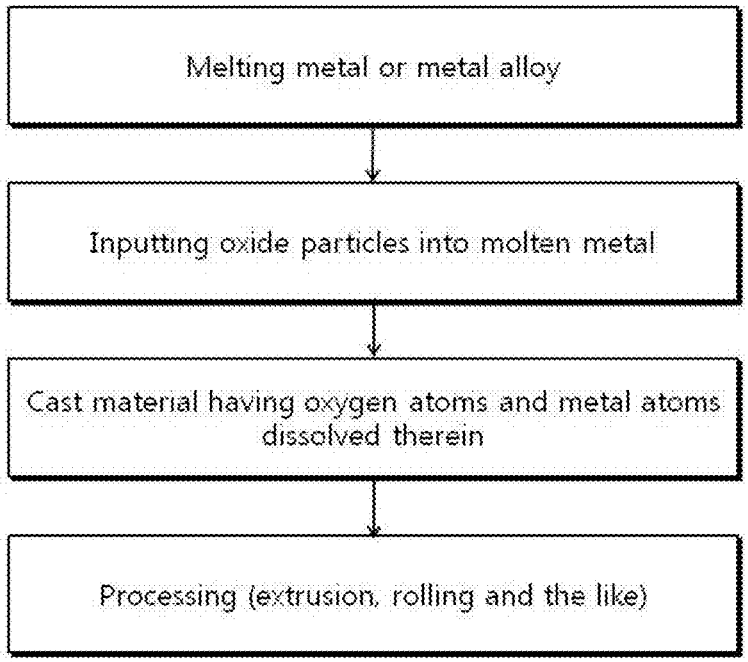
FIG. 1 is a flowchart showing a process of manufacturing an alloy material according to an embodiment of the present invention.

FIG. 1 is a flowchart showing the process of manufacturing a material according to an embodiment 1 of the present invention.

The inventors selected Mg and titania ($TiO_2$, 50 nm) as a metal matrix and nano oxide particles, manufactured a material according to the following process and then evaluated its properties.

Figure 2:
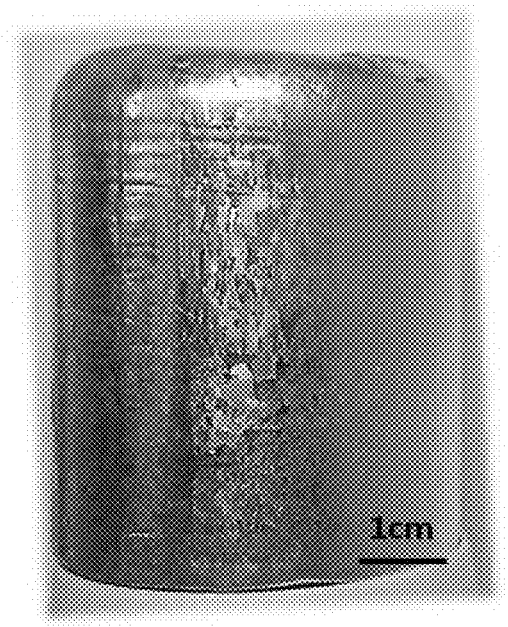
FIG. 2 is a picture showing a cast material that is manufactured according to an embodiment of the present invention.

First, the inventors achieved an extraordinary result of dissolving oxygen atoms by decomposing/dispersing the oxide particles into a matrix metal using a typical casting method. Specifically, pure Mg was melted using an electric melting furnace, and then titania ($TiO_2$, 50 nm) was inputted by a volume ratio of 1% into the molten metal. At this time, the titania powder was prepared in the form of a compact at room temperature so that the titania particles could be inputted into the molten metal. The temperature of the molten metal was increased to 820° C., which was maintained for 30 minutes such that the particles could be decomposed. Afterwards, casting was performed, thereby manufacturing a cast material, which is shown in FIG. 2. A protective gas ($SF_6$+$CO_2$) was used throughout the manufacturing process in order to prevent oxidation. In the meantime, although pure Mg was used in this embodiment, Mg alloys can be also used as will be described below.

Figure 3:
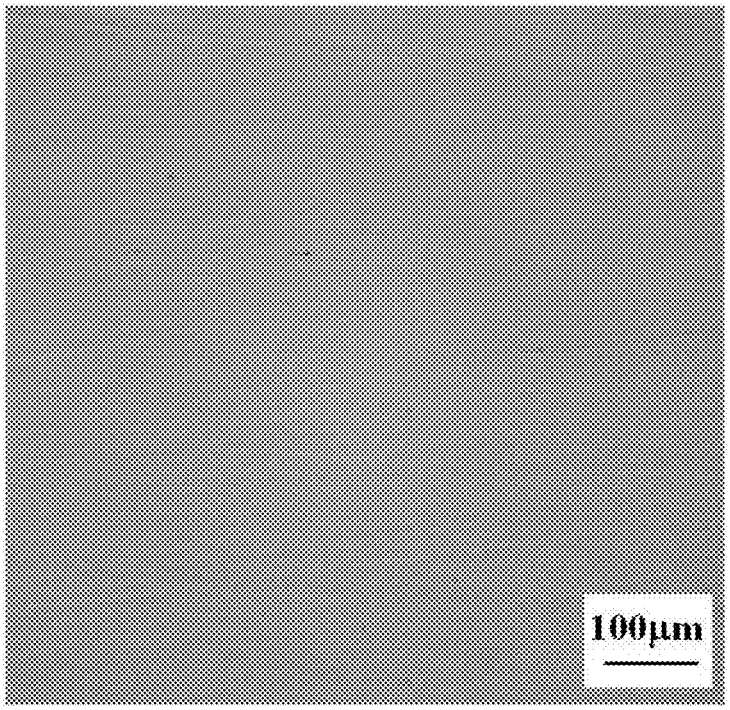
FIG. 3 is an optical microscopy picture obtained by observing a surface of the cast material that is manufactured according to an embodiment of the present invention.
Figure 4:
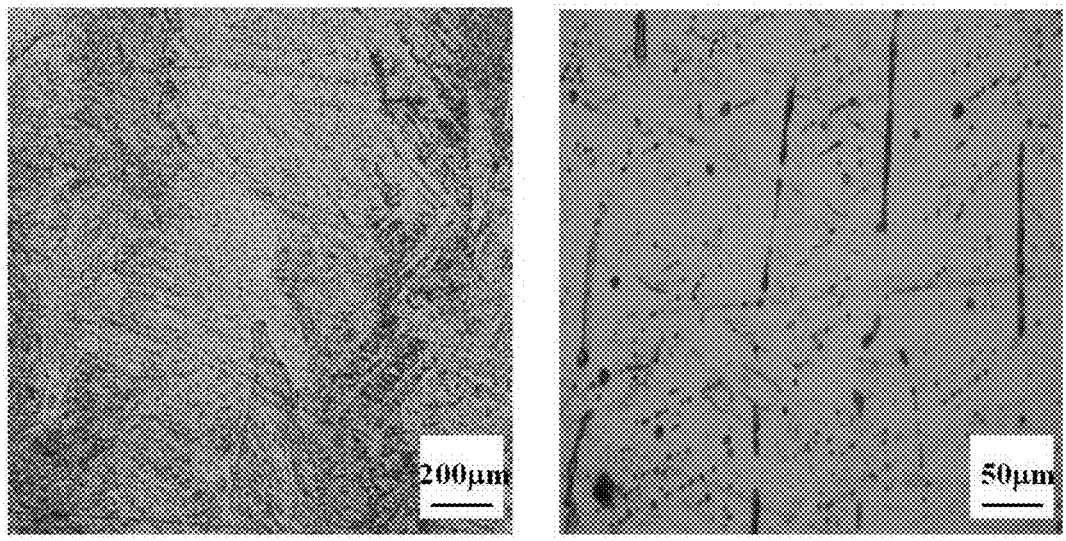
FIG. 4 is a picture of an etched state of the cast material that is manufactured according to an embodiment of the present invention and an enlarged picture thereof.

In order to analyze a microstructure of the Mg material that was manufactured as above, the Mg material before and after etching was observed using an optical microscope, and the results are presented in FIG. 3 and FIG. 4. First, referring to the picture before etching (FIG. 3), this is the picture obtained by observing the cast material that was manufactured by the above-described process using the optical microscope. It can be confirmed that substantially no defects are present inside the cast material. While typical Mg cast materials generally contain a considerable amount of impurities therein, no such defects were observed from the surface of the Mg alloy of the present invention.

After the cast material was etched using picric acid, the surface thereof was observed using an optical microscope. The result is presented at the left part of FIG. 4, and a picture obtained by observing the result at a high magnification is presented at the right part of FIG. 4. From FIG. 4, it can be appreciated that a new phase was formed inside grains through the decomposition of $TiO_2$. If $TiO_2$ was simply dispersed instead of being decomposed, clusters of the particles must have been found considering their size (about 50 nm). However, no clusters were found, and a different phase shown in FIG. 4 was observed.

Figure 5:
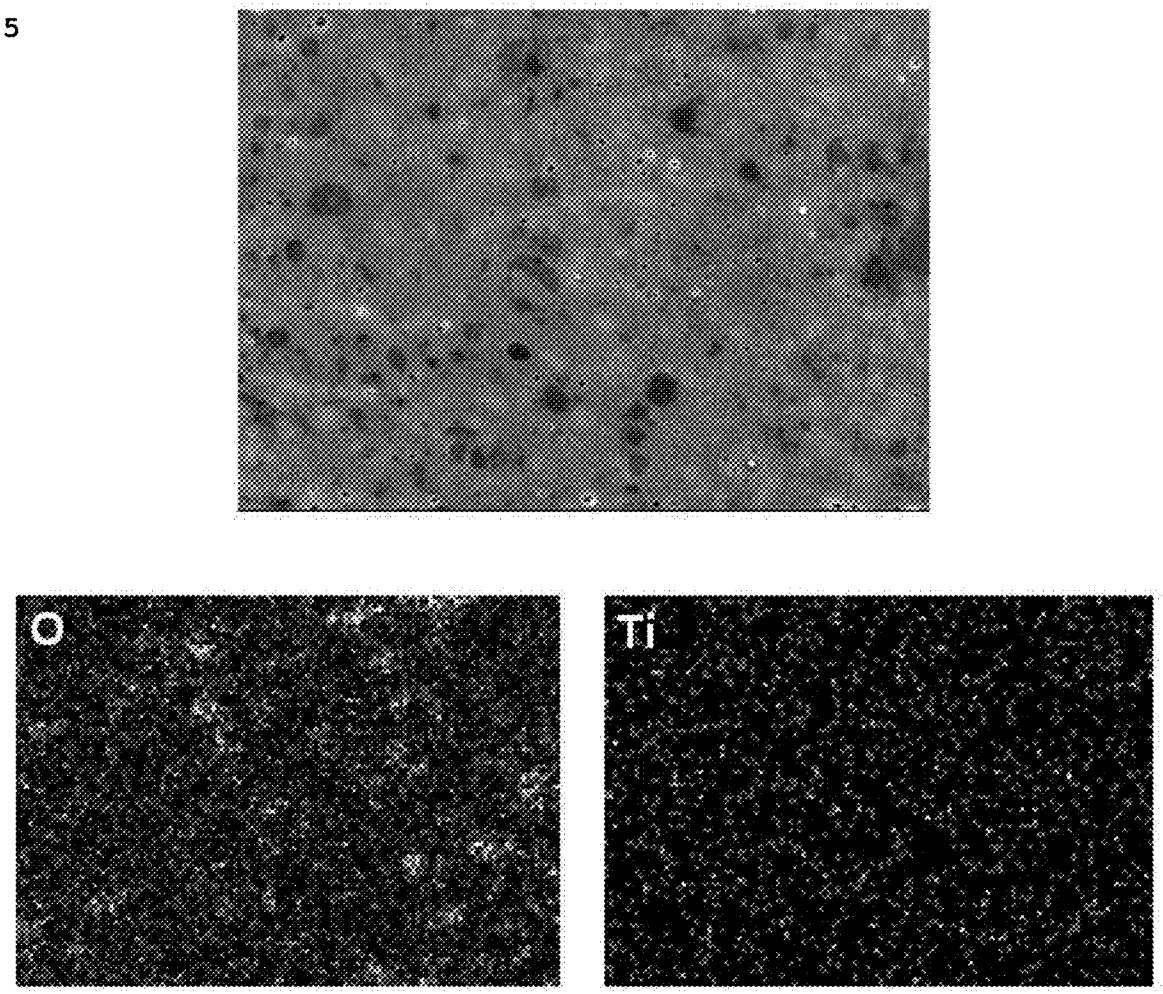
FIG. 5 is a view showing a result of an energy dispersive X-ray spectroscopy (EDS) composition analysis of the cast material that is manufactured according to an embodiment of the present invention.

The inventors observed the microstructure using a scanning electron microscope (SEM) and performed a composition analysis by energy dispersive X-ray spectroscopy (EDS) in order to analyze the microstructure in detail, and the results are presented in FIG. 5. From the EDS pictures shown in FIG. 5, it can be found that O and Ti atoms are uniformly dispersed in the Mg matrix. In addition, since oxygen atoms are densely populated at the area where the new phase is located, it can also be appreciated that the new phase including oxygen atoms is formed. This can be evaluated as being a considerably exceptional result in light of the existing common knowledge. That is, it is believed that titania was divided into Ti and oxygen atoms, such that the O atoms and the Ti atoms were dispersed in the Mg matrix, thereby forming the separate new phase.

B. Embodiment 2

Figure 6:
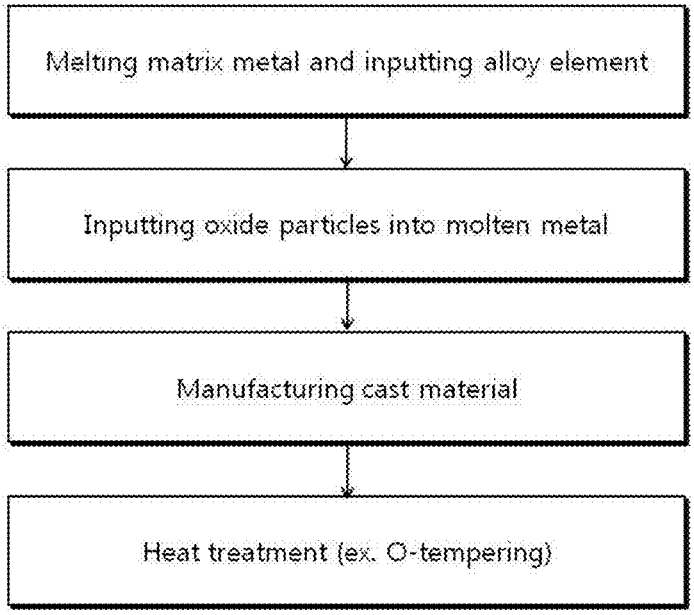
FIG. 6 is a flowchart showing a process of manufacturing an alloy material according to another embodiment of the present invention.

FIG. 6 is a flowchart showing a process of manufacturing a material according to an embodiment 2 of the present invention.

The inventors selected Mg, Al and titania ($TiO_2$, 50 nm) as a metal matrix, an alloy element and nano oxide particles, manufactured a material according to the following process and then evaluated its properties.

In the meantime, the inventors analyzed the selected metal matrix, the alloy element and the nano oxide particles from the viewpoint of the heat of mixing. The heat of mixing is a parameter that shows a difference between enthalpies unique to two different elements when the two elements are present in the liquid form. When the enthalpy difference between the liquids of the two different elements is negative (−), mixing occurs through a mutual reaction between molecules of the two elements. The greater the difference, the easier becomes the mixing (That is, the two different elements tend to aggregate together). In contrast, when the enthalpy difference is positive (+), mixing does not occur since the two elements do not react with each other (That is, the two different elements tend to remain separate from each other). The difference in the heat of mixing between Mg and Ti is +16, the difference in the heat of mixing between Al and Ti is −30, and the difference in the heat of mixing between Mg and Al is −2. Therefore, it can be said that Ti tends to preferentially bond with Al rather than Mg.

First, the inventors achieved an extraordinary result of dissolving oxygen atoms by decomposing/dispersing the oxide particles inside the matrix metal using a typical casting method. Specifically, pure Mg was melted using an electric melting furnace, Al was added by mass ratios of 6, 9 and 12%, and then titania was inputted by a volume ratio of 1% into each molten metal. At this time, the titania powder was prepared in the form of a compact at room temperature so that the titania particles could be inputted into each molten metal. The temperature of the molten metal was increased to 820° C., which was maintained for 30 minutes such that the particles could be decomposed. Afterwards, casting was performed, thereby manufacturing cast materials. A protective gas ($SF_6$+$CO_2$) was used throughout the production process in order to prevent oxidation.

Meanwhile, in the present invention, the grain size of the oxide particles that are inputted is in the nanometer scale (50 nm in this embodiment), and a compact of the oxide particles in the nanometer scale was inputted into the molten metal. Although not specifically shown in the specification, according to the observation of the inventors, when the size of the oxide particles exceeds the nanometer scale, for embodiment, when the oxide particle size was increased to the micrometer scale, even though the oxide particles were inputted into the molten metal, the phenomenon in which the oxide is divided into the metal element and the oxygen atoms was not observed, as will be described later.

Figure 7:
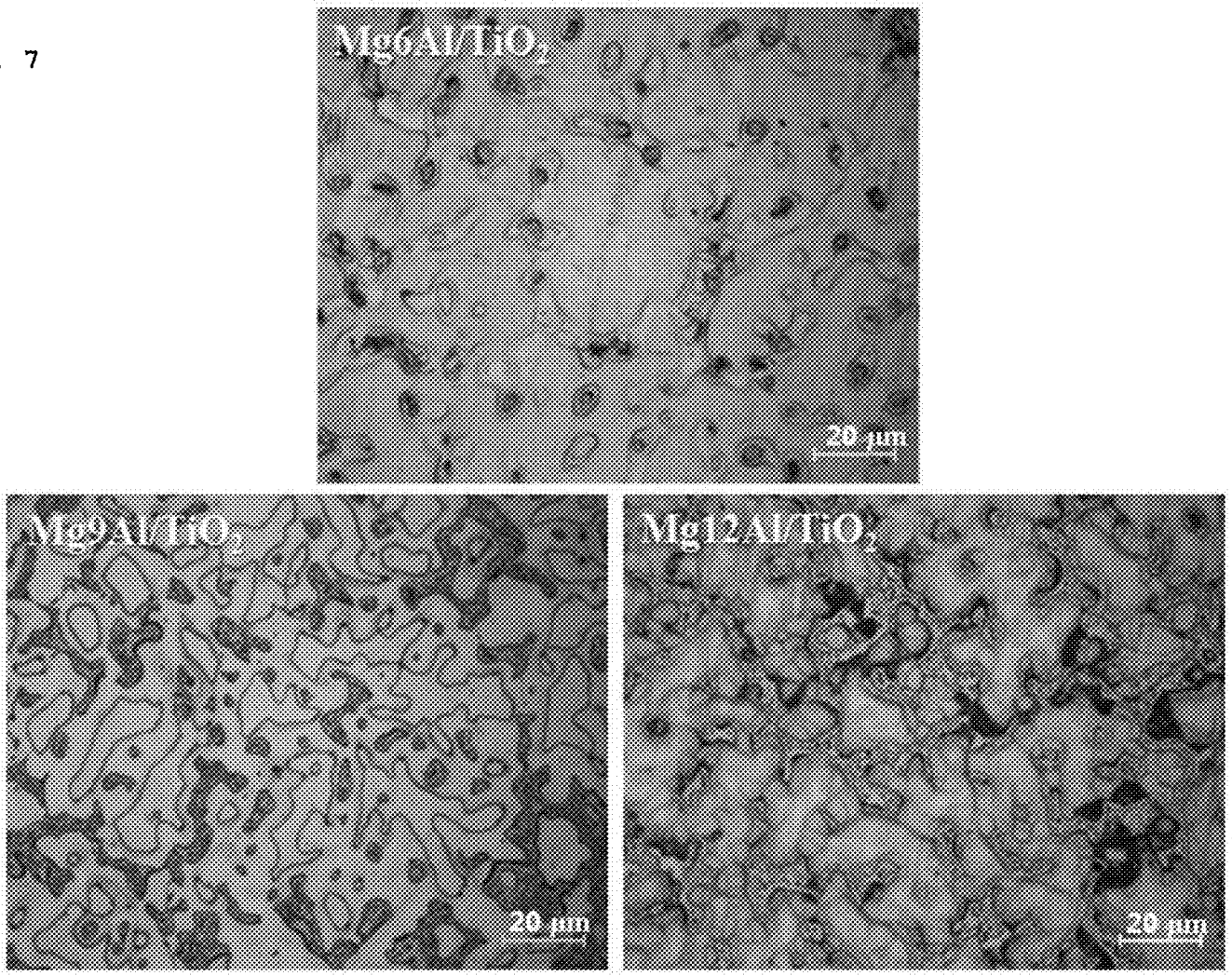
FIG. 7 is a view showing microscopic structures of cast materials manufactured by adding titania into molten metals in which Al was inputted by mass ratios of 6, 9 and 12% into Mg matrixes, followed by decomposition and dispersion, according to an embodiment of the present invention.

In order to analyze microstructures of the Mg materials that were manufactured as above, the Mg alloy materials before and after etching were observed using an optical microscope, and the results are presented in FIG. 7. As shown in the figure, it is apparent that a different new phase was formed instead of the second phase that can be seen from the existing Mg alloy to which Al is added. That is, it is considered that the new phase was formed inside grains through the decomposition of $TiO_2$. This can be evaluated as being a considerably exceptional result in light of the existing common knowledge. That is, the titania is decomposed into Ti and oxygen atoms in the Mg molten metal, and the Ti and oxygen atoms are uniformly dispersed in the molten metal. The oxygen atoms do not form a Mg oxide during solidification, but are present in the quasi-equilibrium state in the Mg—Al matrix. It is also considered that the Ti atoms are dispersed in the alloy matrix and tend to preferentially bond with Al, thereby forming the separate new phase. In addition, not only Ti, but also Zr, Mn, Cr and Fe exhibit a similar tendency in which the liquidus line is raised depending on a concentration gradient with Mg. Describing it in the viewpoint of the heat of mixing, Ti, Mn and the like exhibit a positive (+) heat of mixing with respect to Mg but a negative (−) heat of mixing with respect to Al. Accordingly, they do not form a compound with Mg, but preferentially bond with Al, thereby forming a new phase.

This result is a considerably exceptional result. That is, it is known that the dispersion of oxygen atoms in Mg is impossible in the thermodynamically stable state since Mg has substantially no solubility of oxygen at the liquid/solid phase. In addition, when oxygen is forcibly dissolved, MgO must be formed directly in the viewpoint of thermodynamics. However, according to the present invention, the oxygen atoms were dispersed in Mg instead of forming MgO in the molten metal and during solidification, which was empirically observed and the result of which is in FIG. 7. This is considered as being caused by the employment of the characteristic method that is distinct from the related art methods when manufacturing the Mg alloy.

Specifically, in an attempt to form MgO by inputting oxide particles into the Mg molten metal, it can be regarded that MgO particles are formed when oxygen forms several clusters and MgO nuclei are formed and grown to a predetermined size or greater. For the purpose of removing oxygen to prevent it from residing in the molten metal, the related art involves strongly stirring the molten metal while inputting the oxide particles into the molten metal. The strong stirring forms clusters, such that an oxide such as MgO is consequently formed. Unlike the related-art method that is widely performed, the inventors simply inputted the oxide particles in the steady state. That is, the inventors divided the titania particles into Ti and oxygen atoms by simply inputting the titania particles that were prepared as above into the molten metal, and did not perform the operation of strongly stirring the molten metal in order to mix the particles into the molten metal when inputting the titania particles. Accordingly, it is considered that the condition in which the oxygen atoms divided from the titania can form clusters was not satisfied, such that the nucleation of MgO crystals did not occur. Consequently, MgO is not included in the Mg alloys that were finally manufactured.

In the meantime, the inventors performed heat treatment for the materials that were manufactured as above. That is, in a general production process for a material, heat treatment is performed in order to relax strain hardening and improve ductility (for embodiment, O-tempering; see FIG. 8). It is known that homogenization heat treatment such as O-tempering reduces mechanical characteristics such as strength.

Figure 8:
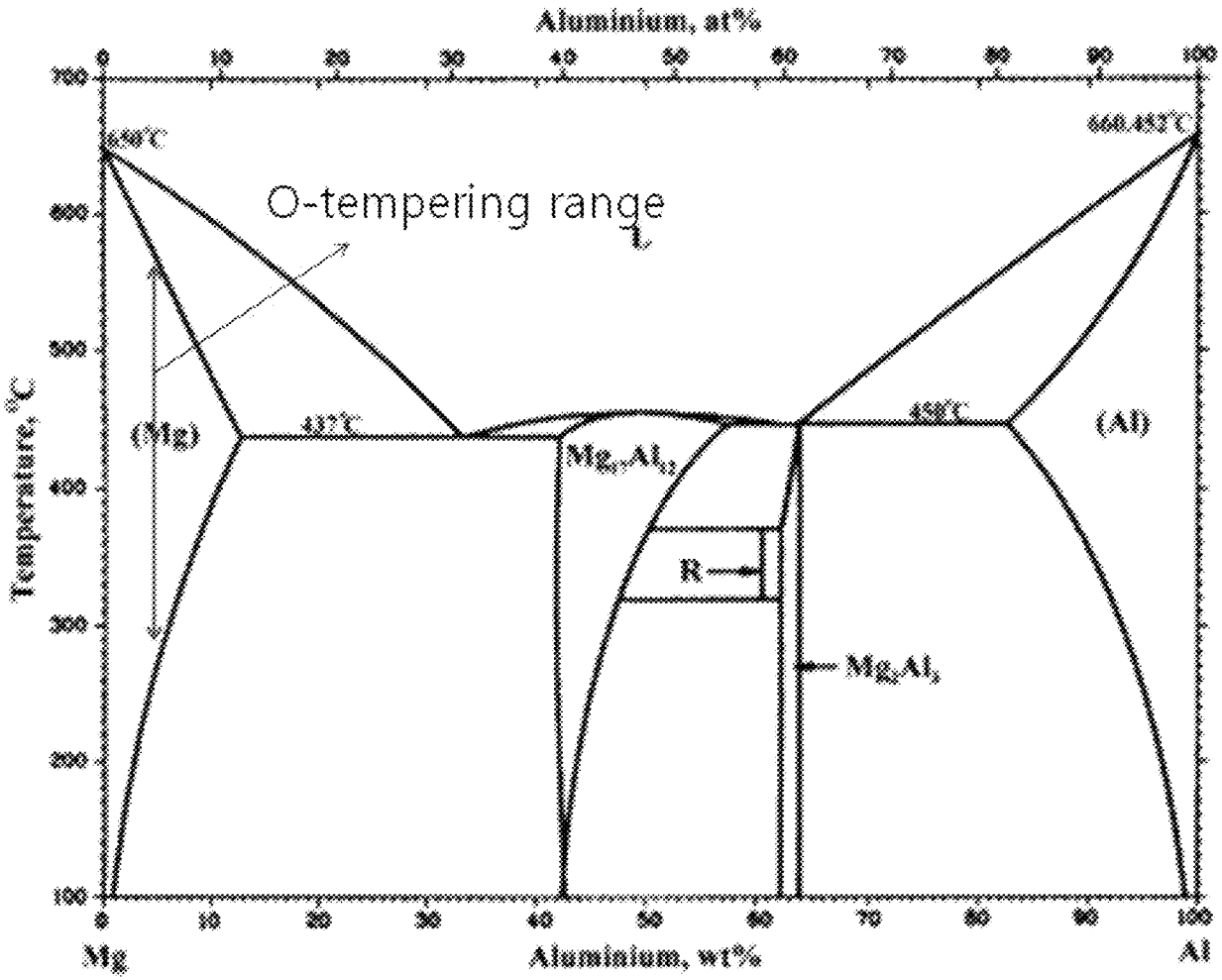
FIG. 8 is a Mg—Al phase diagram.

As apparent from the Mg—Al phase diagram in FIG. 8, heat treatment was performed by maintaining a heat treatment temperature at 400° C. for 12 hours in order to form a single phase in the matrix. The microstructures of the heat-treated materials were observed using an optical microscope, and are shown in FIG. 9.

Figure 9:
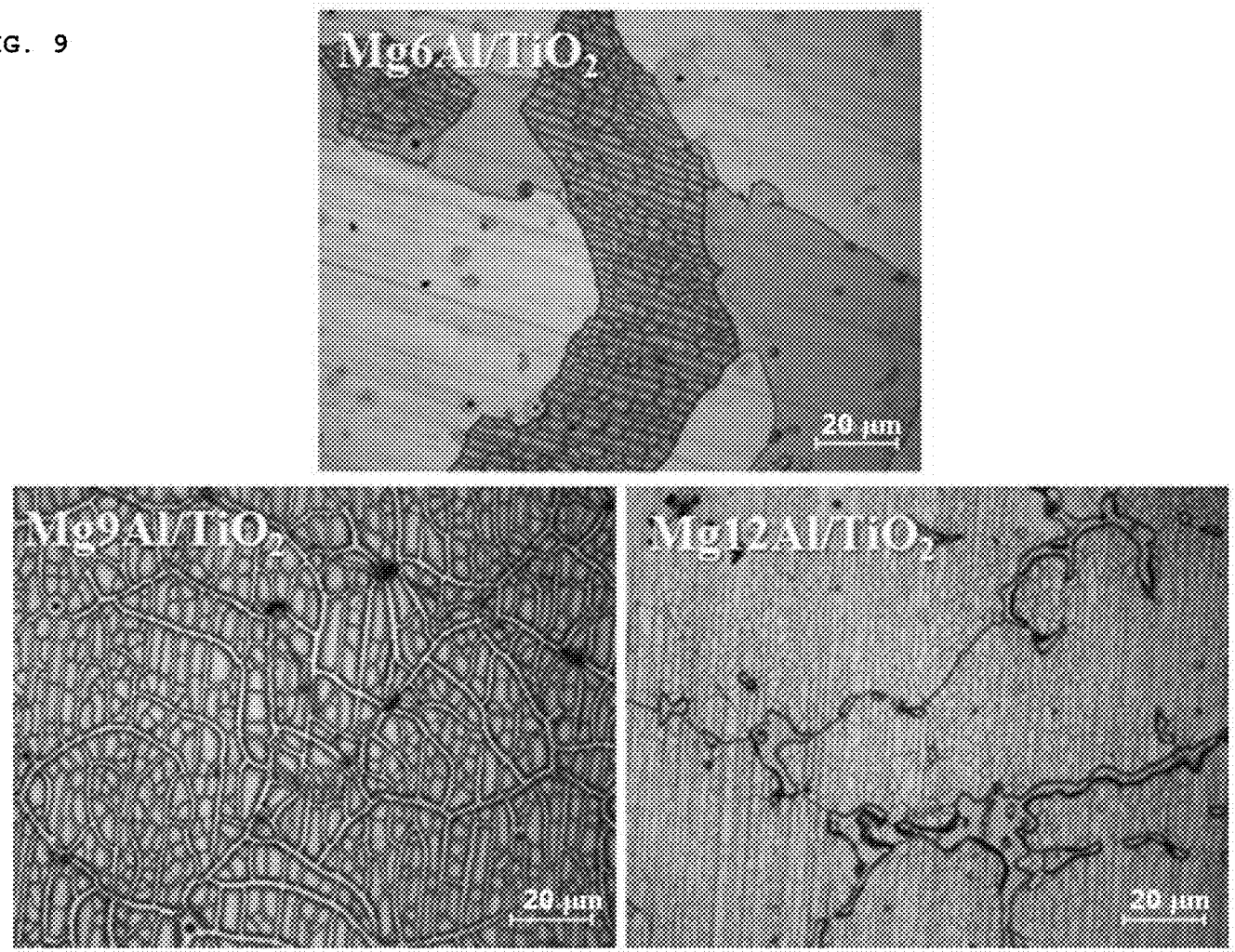
FIG. 9 is a view showing microscopic structures of cast materials manufactured by adding titania into molten metals in which Al was inputted by mass ratios of 6, 9 and 12% into Mg matrixes, followed by decomposition and dispersion, after the cast materials are heat-treated at 400° C. for 12 hours according to an embodiment of the present invention.

As shown in FIG. 9, unlike a microscopic structure seen from the heat treatment process of a typical Mg alloy to which Al is added, it was first discovered that the newly-formed phase made a band structure or network structure depending on the amount of Al. It is apparent that the new phase is formed uniformly across the entire area and its shape becomes more compact in response to the increasing amount of added Al. Specifically, when the titania powder was added to the Mg molten metal, the titania powder became decomposed and divided into Ti atoms and oxygen atoms. At this time, since the Ti atoms do not form a compound with Mg (a positive heat of mixing of +16), a phase composed of Mg and Ti was not formed. The inventors added the titania powder to the Mg molten metal after adding Al thereto. Unlike the case of Mg, the Ti atoms have a negative heat of mixing with Al, and thus the divided Ti atoms will be preferentially distributed around Al atoms. It is considered that, when the material in which the Ti atoms were distributed around Al was heat-treated as described above, a new phase including Mg, Al, Ti and oxygen atoms was formed, thereby making up the phase that forms the band structure or network structure as shown in FIG. 9.

Figure 10:
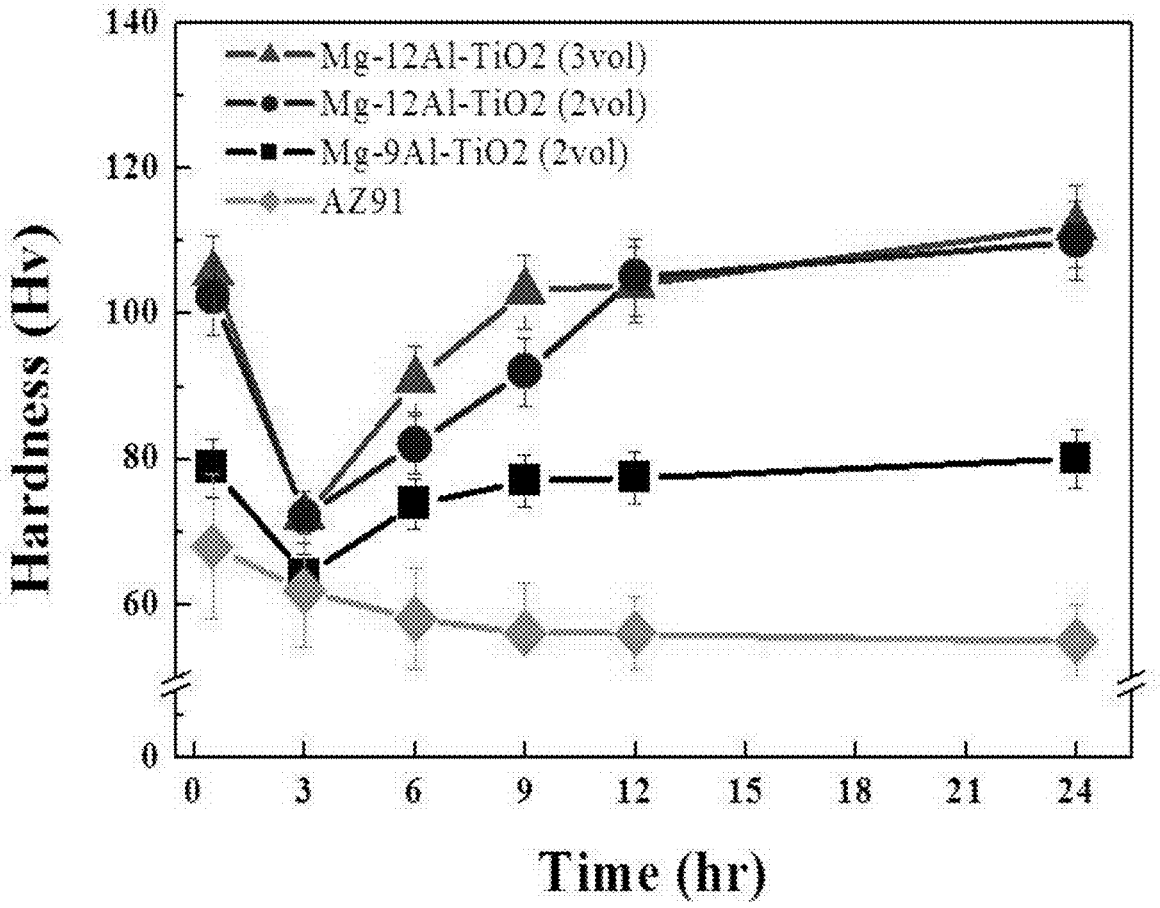
FIG. 10 is a graph showing variations in hardness values depending on processing time in Mg alloys to which Al was added by mass ratios of 9% and 12% and titania was added by a volume ratio of 2%, a Mg alloy to which Al was added by a mass ratio of 12% and titania was added by a volume ratio of 3%, and commercially-available AZ91 Mg alloy.

The inventors compared the materials in which the amounts of Al and titania are different with AZ91 Mg alloy, a commercially available alloy, in relation to hardness values depending on the heat treatment time, and the results are presented in FIG. 10. As shown in FIG. 10, the Mg alloys to which Al was added by mass ratios of 9% and 12% and titania was added by a volume ratio of 2%, the Mg alloy to which Al was added by a mass ratio of 12% and titania was added by a volume ratio of 3%, and AZ91 Mg alloy were compared in relation to the hardness values depending on the heat treatment time. The temperature of the heat treatment was 420° C. It is apparent that the hardness values decrease in all of the materials when heat-treated for 3 hours. This phenomenon occurs as the eutectic phase in the material diffuses into the matrix. However, in the three materials to which titania was added, an improvement in strength could be observed after 3 hours. This seems to be so because the phase having the band structure or network structure shown in FIG. 9 was formed. Therefore, it is possible to confirm a result different from the existing result of the heat treatment, i.e. the result in which the hardness value increases instead of decreasing as the heat treatment time increases. This can be regarded as such because phases that make up a network are formed across the entire inside of the material as the heat treatment time increases. Therefore, in the case of manufacturing a bulk material by applying the present invention, if heat treatment is performed for a sufficient time, it is possible to produce an alloy material that has uniform mechanical characteristics across the entire areas without non-uniformity depending on positions of the material in relation to the mechanical characteristics, such as hardness or strength.

Figure 11:
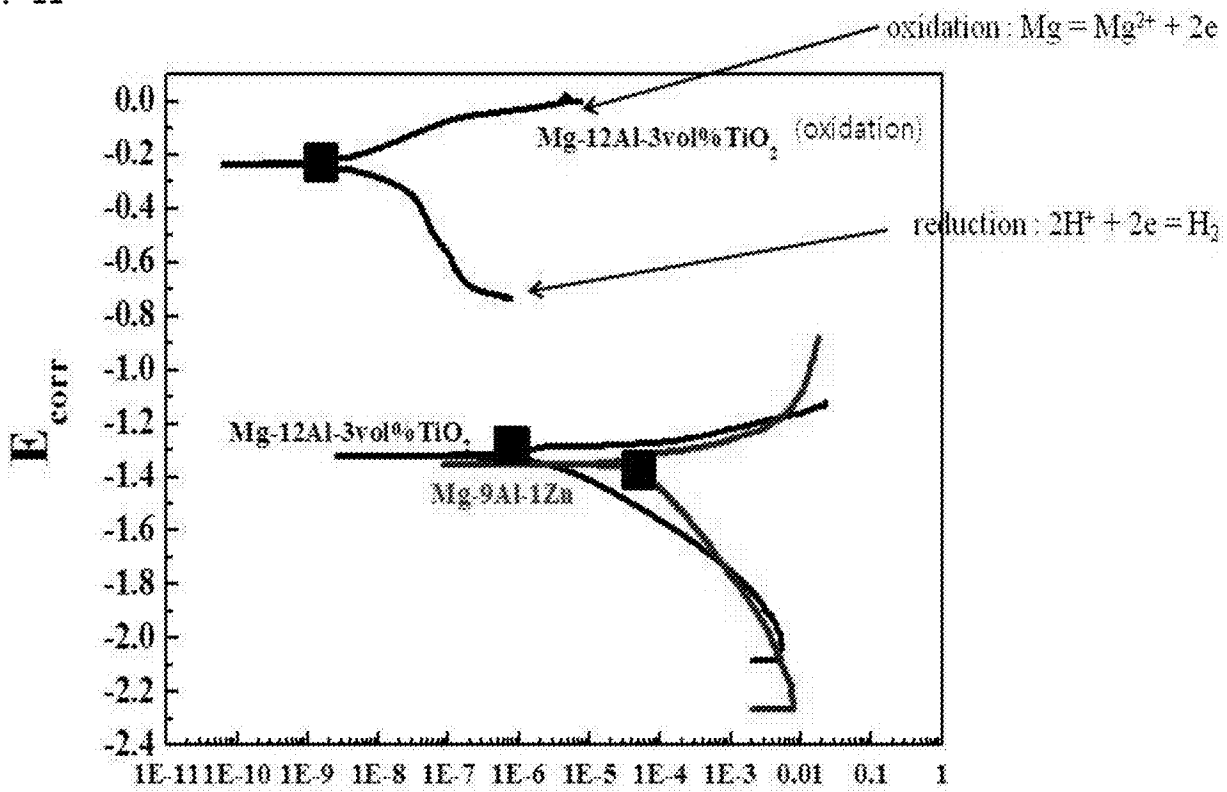
FIG. 11 is a graph comparing a corrosion curve that was obtained by performing a corrosion test on a cast material, the cast material being manufactured by adding titania by a volume ratio of 3% into a molten metal in which Al was added by a mass ratio of 12% into a Mg matrix, after performing heat treatment (oxidation) for the cast material with those of existing AZ91 alloy and an alloy of the same cast material before heat treatment.

In addition, the inventors performed a corrosion test on the cast materials that were manufactured as above by polishing their surface and then heat-treating them at 420° C. for 24 hours, and the results are presented in FIG. 11. The above-mentioned heat treatment process (oxidation) is one of the methods that improve a corrosion value by forming an oxide film on the surface of the cast material or a processed material. However, it is difficult to improve the corrosion value of Mg since the oxide film is not uniformly formed on the surface even if surface treatment such as heat treatment is performed, which is problematic. In contrast, in the case of the cast material that was heat-treated according to the present invention, the uniform oxide film is formed on the surface thereof. Accordingly, it can be appreciated that the corrosion curve is significantly improved over the corrosion curve of AZ91 alloy, a commercially available alloy, and the corrosion curve of the cast material before heat treatment.

The results of FIG. 11 will be described in more detail as follows. A time when a metal emits an electron (a time when corrosion occurs) is referred to as polarization potential $E_{corr}$. As shown in FIG. 11, the electron emission time is a time when a reaction is converted from reduction into oxidation. This reaction can be measured by a corrosion test, and the polarization potential as well as a corrosion rate ($I_{corr}$, corrosion current density) can be presented as in FIG. 11 (Tefal curve). Referring to the Tefal curve, it is possible to determine the amount of corrosion that occurs when a voltage is applied. For instance, referring to FIG. 11, when a voltage of −1.3V is made to flow, the difference in corrosion rates between a sample to which $TiO_2$ was added and an AZ91 sample is $10^{-2}$. This indicates that the sample to which $TiO_2$ was added corrodes about 100 times slower than the AZ91 sample. In addition, it can be appreciated that no corrosion occurs when the voltage of −1.3V is made to flow through the sample that underwent heat treatment (oxidation) but corrosion occurs at a higher voltage of −0.2V. The rate shows rate differences of $10^{-3}$ and $10^{-5}$ compared to the sample that was not heat-treated and the AZ91 sample. This indicates that corrosion occurs about 1000 and 100,000 times more slowly, and that the corrosion characteristics are significantly improved.

Figure 12:
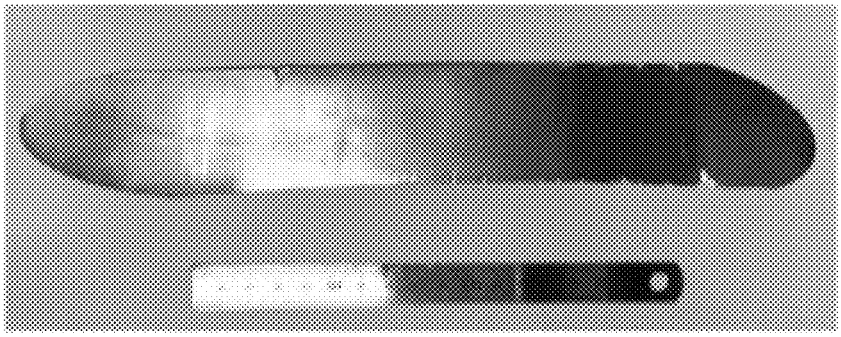
FIG. 12 is a picture showing a rolled material obtained by rolling a cast material manufactured according to an embodiment of the present invention.
Figure 13:
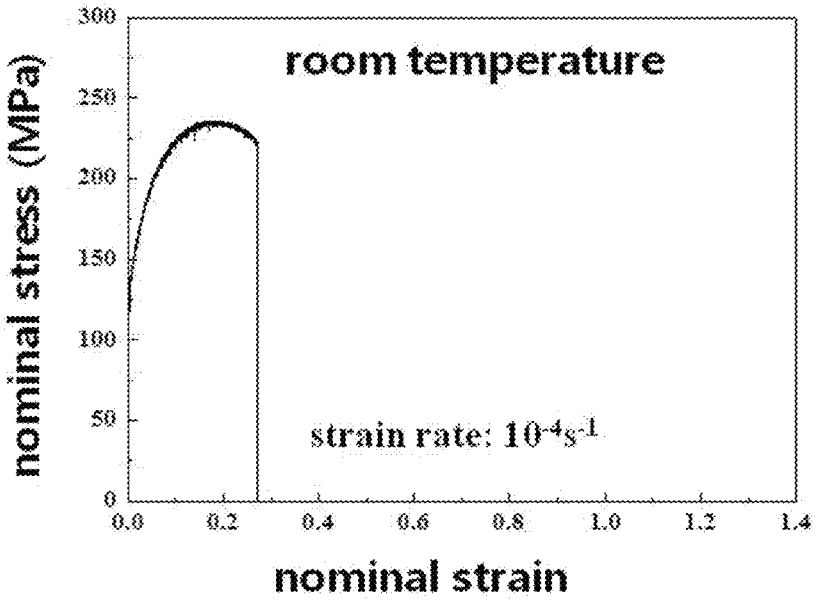
FIG. 13 is a graph showing a tensile test performed for the foregoing rolled material.
Figure 13:
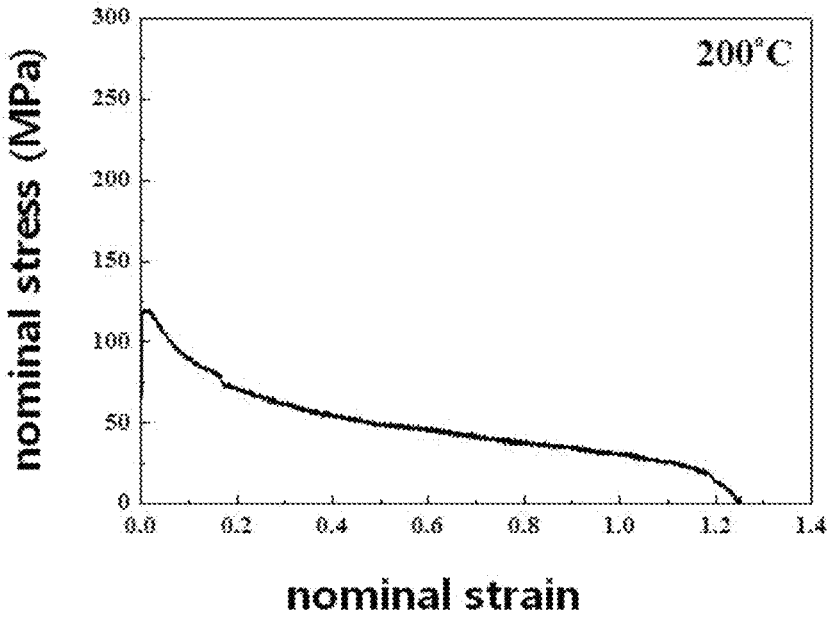

The inventors hot-rolled a cast material in which oxygen atoms are dissolved as proposed in the foregoing embodiment at 380° C., and the resultant rolled material is shown in FIG. 12. Specifically, titania ($TiO_2$) was inputted by a volume ratio of 1% into a molten metal which was obtained by melting Al by a mass ratio of 3% into pure Mg. The resultant molten metal was maintained at a constant temperature for 30 minutes, followed by casting. A protective gas ($SF_6$+$CO_2$) was used throughout the production process in order to prevent oxidation. This is the same as described in the foregoing embodiment. The cast material manufactured as above was hot-rolled at a reduction ratio of 15% from the initial thickness 10 mm to 0.8 mm at 380° C., thereby manufacturing a Mg rolled material, and a tensile test was performed at room temperature and 200° C. The nominal strain-nominal stress graphs obtained from the tensile test at room temperature and 200° C. are shown in FIG. 13. The tensile test was performed at a tensile speed of $10^{-4}s^{-1}$ at room temperature and $10^{-3}s^{-1}$ at 200° C. As shown in FIG. 13, it is apparent that the material shows superior elongation at room temperature and high temperature.

Although the present invention has been described hereinabove with respect to the preferred embodiments, it should be understood that the present invention is not limited to the foregoing embodiments. Although the foregoing embodiments were described as using ceramic particles, i.e. titania ($TiO_2$), by way of embodiment, the present invention is not limited thereto. For embodiment, it is possible to apply particles of an oxide matrixd on a metal element that has a positive heat of mixing with respect to a matrix metal and a negative heat of mixing with respect to an alloy element, for embodiment, an oxide selected from among Mn oxides (MnOx), Cr oxides (CrOx), Zr oxides (ZrOx) and Fe oxides (FeOx), to the present invention. In addition, even if an oxide is soluble to the matrix metal (e.g., Ca oxides (CaOx), Sr oxides (SrOx), Ba oxides (BaOx), Zn oxides (ZnOx), Si oxides (SiOx), Al oxides (AlOx), Y oxides (YOx), rare earth oxides (REOx) and Sn oxides (SnOx)), when the oxide is inputted by the foregoing production method according to the present invention (i.e. inputted in the static state without being strongly stirred), it can be decomposed and heat-treated according to the present invention in order to form a new phase that makes up a band or network structure across the entire matrix metal, thereby improving the mechanical characteristics of the alloy material. As set forth above, the present invention can be made into various alterations and modifications without departing from the scope of the appended claims, and all such alterations and modifications fall within the scope of the present invention. Therefore, the present invention shall be defined by only the claims and their equivalents.

The invention claimed is:

1. A cast alloy material having a composition of magnesium (Mg), aluminum (Al), and additional metal atoms and oxygen atoms, both of the additional metal atoms and the oxygen atoms being atoms decomposed from the same material in form of oxide nanoparticles having a nanometer scale size, the oxide nanoparticles being transition metal oxide nanoparticles, the additional metal atoms including titanium (Ti), the cast alloy material comprising:

a matrix metal comprising Mg—Al alloy containing composition Mg 80% or more; and an oxide layer which is formed on a surface of the matrix metal, wherein the additional oxygen atoms do not form an oxide with the Mg of the matrix metal and are dispersed in the matrix metal, and the additional oxygen atoms exist in a quasi-equilibrium state in the matrix metal, wherein the additional metal atoms have a positive (+) heat of mixing with respect to the Mg and a negative (−) heat of mixing with respect with the Al and are distributed around the Al of the matrix metal, wherein the oxide nanoparticles comprise Ti oxides, wherein the cast alloy material has intermetallic phases having a band or network structure and the intermetallic phases include the magnesium (Mg), the aluminum (Al), the additional metal atoms and the oxygen atoms, thereby improving mechanical characteristics and corrosion characteristics of the cast alloy material, wherein the cast alloy material has hardness greater than 100 Hv and lower than 110 Hv.

2. The cast alloy material according to claim 1, wherein the cast alloy material comprises none of the oxide nanoparticles.

3. The cast alloy material according to claim 1, wherein the oxygen atoms of the oxide nanoparticles are dispersed in the matrix metal, before the metal element of the oxide nanoparticles is dispersed in the matrix metal, so that the oxygen atoms and the metal element are mixed with the matrix metal.

4. The cast alloy material according to claim 1, wherein the metal element having a relationship of a positive heat of mixing with the Mg and a relationship of a negative heat of mixing with the Al are decomposed, so that a phase comprising the Al, the metal element and the oxygen atoms and having a band or network structure.

5. The cast material according to claim 1, further comprising: an oxide film on a surface of the cast alloy material.

6. A cast alloy material having a composition of magnesium (Mg), aluminum (Al), and additional metal atoms and oxygen atoms, both of the additional metal atoms and the oxygen atoms being atoms decomposed from the same material in form of oxide nanoparticles having a nanometer scale size, the oxide nanoparticles being transition metal oxide nanoparticles, the cast alloy material comprising:

a matrix metal comprising Mg—Al alloy containing composition Mg 80% or more; and an oxide layer which is formed on a surface of the matrix metal, wherein the additional oxygen atoms do not form an oxide with the Mg of the matrix metal and are dispersed in the matrix metal, and the additional oxygen atoms exist in a quasi-equilibrium state in the matrix metal, wherein the additional metal atoms have a positive (+) heat of mixing with respect to the Mg and a negative (−) heat of mixing with respect with the Al and are distributed around the Al of the matrix metal, wherein the additional metal atoms comprise titanum (Ti), wherein the additional metal atoms has a tendency in which a liquidus line is raised depending on a concentration gradient with the Mg, wherein the cast alloy material has intermetallic phases having a band or network structure, the intermetallic phases include the magnesium (Mg), the aluminum (Al), the additional metal atoms and the oxygen atoms, and the cast alloy material has hardness greater than 100 Hv and lower than 110 Hv, wherein in the intermetallic phases, atomic percent of the metal atoms of the Mg—Al alloy being larger than atomic percent of the oxygen atoms.

7. The cast alloy material according to claim 1, wherein the at least two phases are formed during a process of homogenization heat treatment.

8. The cast alloy material according to claim 1, wherein a liquidus line of the cast material is raised depending on a concentration gradient with the metal element and the matrix metal.

9. A cast alloy material having a composition of magnesium (Mg), aluminum (Al), and additional metal atoms and oxygen atoms, both of the additional metal atoms and the oxygen atoms being atoms decomposed from the same material in form of oxide nanoparticles having a nanometer scale size, the additional metal atoms including Titanium (Ti), the cast alloy material comprising:

a matrix metal comprising Mg—Al alloy containing composition Mg 80% or more; and an oxide layer which is formed on a surface of the matrix metal, wherein the additional oxygen atoms do not form an oxide with the Mg of the matrix metal and are dispersed in the matrix metal, wherein the additional metal atoms have a positive (+) heat of mixing with respect to the Mg and a negative (−) heat of mixing with respect with the Al and are distributed around the Al of the matrix metal, wherein the oxide nanoparticles comprise Ti oxides, wherein the cast alloy material has intermetallic phases having a band or network structure and the intermetallic phases include the magnesium (Mg), the aluminum (Al), the additional metal atoms and the oxygen atoms, thereby improving mechanical characteristics and corrosion characteristics of the cast alloy material, wherein the cast alloy material has hardness greater than 100 Hv and lower than 110 Hv.

* * * * *